US006095782A

United States Patent [19]

Arbogast et al.

[11] Patent Number: 6,095,782

[45] Date of Patent: Aug. 1, 2000

[54] CRESCENTLESS INTERNAL GEAR PUMP

[75] Inventors: Franz Arbogast; Peter Peiz, both of Heidenheim, Germany

[73] Assignee: Voith Turbo GmbH & Co KG, Heidenheim, Germany

[21] Appl. No.: 09/234,858

[22] Filed: Jan. 22, 1999

[30] Foreign Application Priority Data

Feb. 3, 1998 [DE] Germany ..... 198 04 134

[51] Int. Cl.[7] ..... F01C 1/10

[52] U.S. Cl. ..... 418/168; 418/112; 418/113; 418/124

[58] Field of Search ..... 418/168, 112, 418/113, 124

[56] References Cited

U.S. PATENT DOCUMENTS

| | | | |
|---|---|---|---|
| 2,790,394 | 4/1957 | Mori | 418/168 |
| 3,429,269 | 2/1969 | Walter | 418/168 |
| 5,354,188 | 10/1994 | Arbogast et al. | 418/132 |
| 5,399,079 | 3/1995 | Peiz et al. | 418/168 |
| 5,540,573 | 7/1996 | Arbogast et al. | 418/168 |

FOREIGN PATENT DOCUMENTS

| | | |
|---|---|---|
| 0607497 A1 | 7/1994 | European Pat. Off. . |
| 0607497 B1 | 6/1996 | European Pat. Off. . |
| 2528990 | 9/1969 | Germany . |
| 19712169 C1 | 3/1998 | Germany . |

*Primary Examiner*—Thomas Denion
*Assistant Examiner*—Theresa Trieu
*Attorney, Agent, or Firm*—Randall J. Knuth

[57] ABSTRACT

A crescentless internal gear pump includes a housing with an intake connection and a pressure connection. An internally toothed internal gear has an outside surface and is disposed for rotation within the housing. Each tooth includes a head and a base, the internal gear having radial openings that form a conducting connection between a tooth base and the outside surface. A pinion, which is rotatably disposed within the housing and meshing with the internal gear, has teeth with each tooth including a head. The teeth of one of the internal gear and pinion, includes a profile groove with a base provided in the heads into which a sealing element is disposed and which slides on an opposing tooth head. The sealing element has a sealing surface and includes a channel that produces a conducting connection between the profile groove base and the sealing surface. The sealing element is slightly movable in the profile groove in the radial direction to form a controlled gap.

2 Claims, 2 Drawing Sheets

CRESCENTLESS INTERNAL GEAR PUMP

BACKGROUND OF THE INVENTION

1. Field of the Invention

The invention concerns a crescentless internal gear pump with an internally toothed internal gear, a pinion that meshes with the internal gear and a housing that accommodates the internal gear and pinion.

2. Description of the Related Art

This type of internal gear pump is known, for example, from EP 0 607 497 B1. The tooth heads of the hollow gear and the tooth heads of the pinion are each provided with a profile groove. A sealing element is inserted into the individual profile groove, which slides on the opposite tooth head of the pinion and internal gear during operation of the internal gear pump. The sealing element is provided with a channel that extends through the sealing element and makes a conducting connection between the base of the profile groove and the sealing surface of the sealing element. This ensures that the sealing element acquires the pressure necessary to force the sealing element against the opposite tooth head before the dead point is reached. After passing the dead point, however, the entire working pressure generated by the pump is not on the sealing element, but only a partial pressure.

Internal gear pumps with such sealing elements have proven themselves in principle.

The cited sealing elements are slightly moveable in the profile groove in the radial direction. The outer surface of each sealing element necessarily forms a gap with the inner surface of the profile groove. Control oil reaches this gap from the pressure side of a tooth head with the inserted sealing element in the internal space of the profile groove, i.e., the profile groove base. There the control oil enters the channel that passes through the sealing element in order to emerge again on the sealing surface of the sealing element in the region of the opposite tooth of the pinion or internal gear.

It has been shown that, despite the channel that passes through the sealing element, control of oil flow and thus the pressure with which the sealing element is forced against the opposite tooth head is not optimal. Especially at high pressures, for example at pressures of 250 bar, fluctuations in pressure force occur. These fluctuations are disadvantageous, especially with reference to the sealing effect between the sealing element, on the one hand, and the opposite tooth, on the other, and thus the efficiency and operating method of the entire internal gear pump is less than optimal.

SUMMARY OF THE INVENTION

The underlying task of the invention is to configure a crescentless internal gear pump so that the pressure force of the sealing element against the head of the opposite tooth remains essentially the same, especially at high system pressures.

The present invention comprises, a crescentless internal gear pump, including a housing with an intake connection and a pressure connection. The cresentless internal gear pump also includes an internally toothed internal gear comprising an outside surface, the internal gear disposed for rotation within the housing, each tooth including a head and a base, and the internal gear having radial openings that form a conducting connection between a tooth base and the outside surface. A pinion, which is rotatably disposed within the housing and meshing with the internal gear, having teeth with each tooth including a head is also included. The teeth of one of the internal gear and pinion include a profile groove with a base provided in the heads, into which a sealing element is disposed and which can slide on an opposing the tooth head. The sealing element includes a sealing surface and a channel that produces a conducting connection between the profile groove base and the sealing surface, the channel enclosed by the body of the sealing element as viewed in the rotation direction of the pinion. The sealing element slightly movable in the profile groove in the radial direction to form a gap between the sealing element and an inner surface of the profile groove so that the profile groove base is in a conducting connection with the pressure connection. One of the sealing element and profile groove is configured so that the width of the gap in any radial position of the sealing element is substantially the same.

The present invention also comprises, inform thereof, a crescentless internal gear pump in which, viewed in an axial section, each sealing element includes a dovetail shaped part includes at least one groove is made in one of an outer surface of the sealing element or in the inner surface of the profile groove.

The inventors have recognized that the width of the gap between the outer surface of the sealing elements and the inner surface of the profile groove changes during operation, especially during radial displacement of the sealing element. The amount of control oil that flows from the pressure side through the cited gap to the profile groove base is changed on this account. Accordingly, the inventor proposes that the width of the gap situated on the pressure side remain unchanged, regardless of the prevailing operating parameters.

Numerous variants are possible. For example, the sealing element can be provided with appropriately configured grooves.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
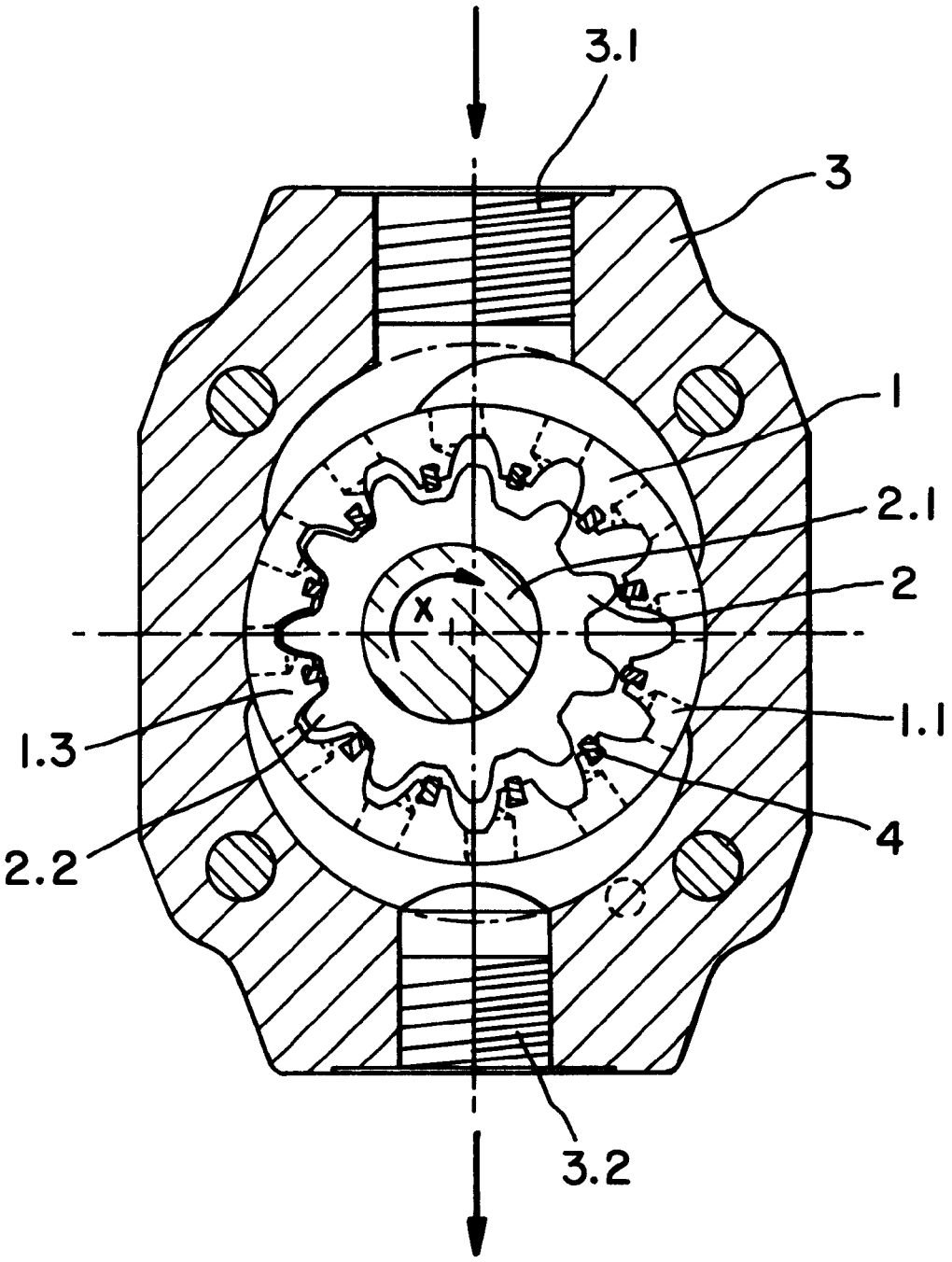
FIG. 1 shows a crescentless internal gear pump in an axial section.

The internal gear pump depicted in FIG. 1 is a crescentless, head-sealing and backlash-encumbered pump. It includes as essential elements an internal gear 1, a pinion 2, as well as a housing 3. The internal gear 1 is provided with holes or Radial Openings 1.1. These produce a conducting connection between the surroundings and outside surface of the internal gear 1, on the one hand, and the intermediate space between internal gear 1 and pinion 2, on the other.

Sealing elements 4 are inserted into profile groups in the teeth of the internal gear.

Pinion 2 is wedged on a pinion shaft 2.1 that rotates in the direction of arrow X within internal gear 1.

The housing 3 has an intake connection 3.1 and a pressure connection 3.2.

The teeth 1.3 of the internal gear and the teeth 2.2 of the pinion have a certain axial width. Internal gear 1 and pinion 2 are mounted eccentrically to each other. Moreover, the number of teeth 2.2 of pinion 2 is one less than the number of teeth 1.3 of internal gear 1.

Figure 2:
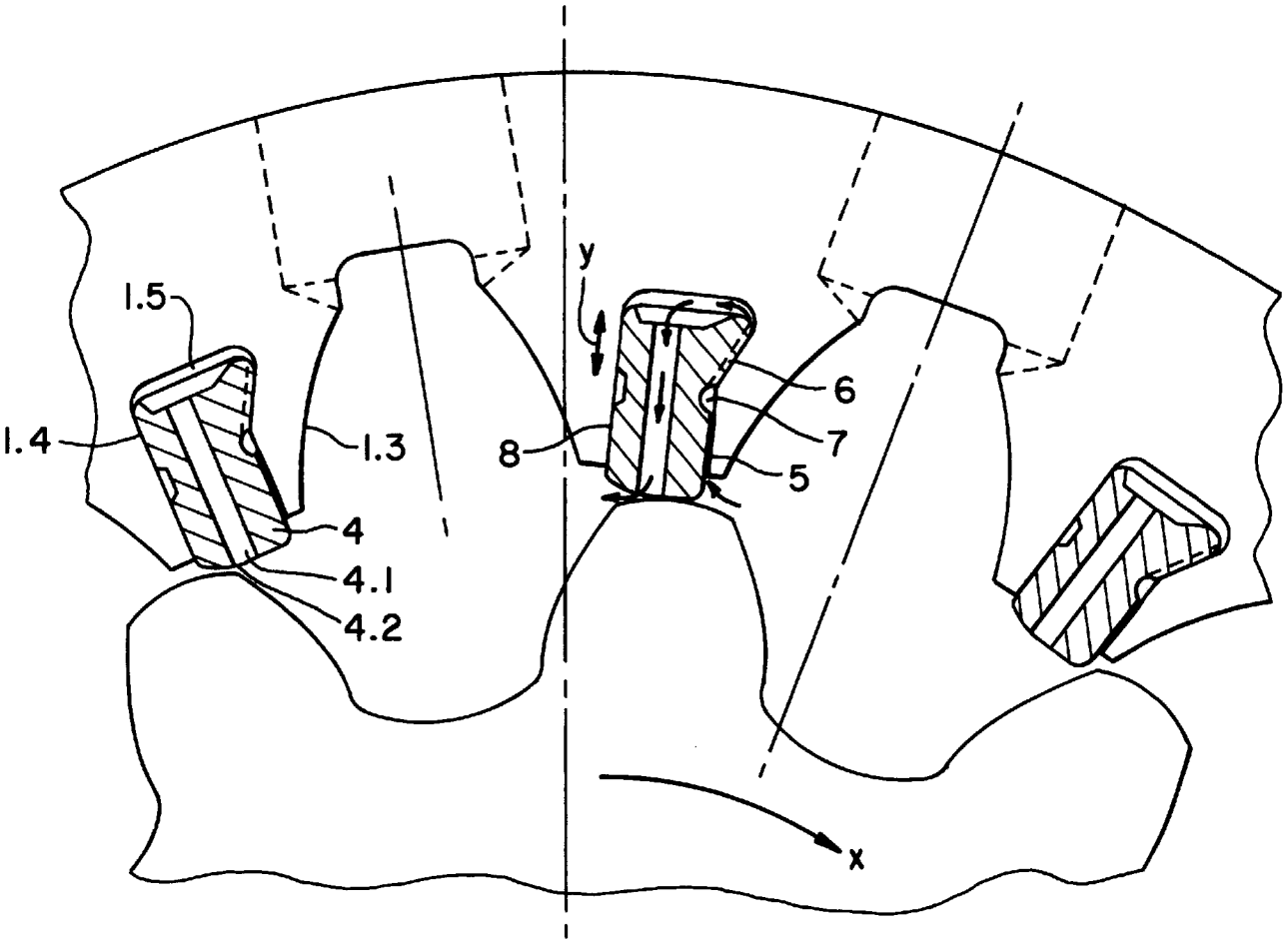
FIG. 2 shows the internal gear pump according to FIG. 1 in a first variant.

The following are apparent in particular from FIG. 2. Each tooth 1.3 of the internal gear 1 has a profile groove 1.4. A sealing element 4 is inserted into each profile groove 1.4. This element 4 is configured in dovetail fashion on part of its cross section. Each sealing element 4 has a continuous channel 4.1. This produces a conducting connection between the internal space or profile base 1.5 and the sealing surface 4.2 of the sealing element 4.

As is apparent from the double arrow Y, the sealing element 4 during operation of the internal gear pump can execute a radial movement. The other arrows shown on the center sealing element indicate the trend of the control oil flow. As is apparent, the control oil stream coming from the pressure side initially enters a gap 5 formed between the outer surface of the sealing element 4 and the inner surface of the profile groove 1.4. A groove 6 is made in the sealing element in the dovetail-shaped part of the sealing element. In the center part of the sealing element 4 a continuous groove 7 is provided. Groove 6 is configured and arranged so that the control oil flow is not throttled from the continuous groove 7 to the groove base 1.5. The width of the entire channel is also always the same during a radial displacement of the sealing element 4. The first section of this flow channel, namely gap 5, is parallel to the contact surface 8 and thus independent in gap height of the radial movements Y.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A crescentless internal gear pump, comprising:

a housing having an intake connection and a pressure connection;

an internally toothed internal gear including an outside surface, said internal gear disposed for rotation within said housing, said each tooth including a head and a base, said internal gear having radial openings that form a conducting connection between a said tooth base and said outside surface;

a pinion having teeth with each tooth including a head, said pinion rotatably disposed within said housing and meshing with said internal gear;

said teeth of one of said internal gear and pinion having a profile groove with a base provided in said heads into which a sealing element is disposed and which can slide on an opposing said tooth head; and said sealing element includes a sealing surface, said sealing element includes a channel that produces a conducting connection between said profile groove base and said sealing surface, said channel enclosed by the body of the sealing element as viewed in the rotation direction of said pinion, said sealing element slightly movable in said profile groove in the radial direction to form a gap between said sealing element and an inner surface of said profile groove so that said profile groove base is in a conducting connection with said pressure connection, one of said sealing element and profile groove configured so that the width of said gap in any radial position of sealing element is substantially the same.

2. The Crescentless internal gear pump of claim 1 in which, as viewed in an axial section, each said sealing element includes a dovetail shaped part and that in the region of said dovetailed-shaped part, at least one groove is made in one of an outer surface of said sealing element or in the inner surface of the profile groove.

* * * * *